United States Patent [19]

Le et al.

[11] Patent Number: 4,990,713

[45] Date of Patent: Feb. 5, 1991

[54] PROCESS FOR THE PRODUCTION OF HIGH VI LUBE BASE STOCKS

[75] Inventors: Quang N. Le, Cherry Hill, N.J.; Robert A. Ware, Wyndmoor, Pa.; Stephen S. Wong, Medford, N.J.

[73] Assignee: Mobil Oil Corporation, Fairfax, Va.

[21] Appl. No.: 267,888

[22] Filed: Nov. 7, 1988

[51] Int. Cl.[5] ..... C07C 2/58

[52] U.S. Cl. ..... 585/332; 585/732; 585/722; 585/723

[58] Field of Search ..... 585/331, 332, 732, 722, 585/723

[56] References Cited

U.S. PATENT DOCUMENTS

| | | | |
|---|---|---|---|
| 2,257,193 | 9/1941 | Rosen | 585/732 |
| 3,128,246 | 4/1964 | Oberright . | |
| 3,594,320 | 7/1971 | Orkin . | |
| 3,773,843 | 11/1973 | Schmerling | 585/732 |
| 4,140,619 | 2/1979 | van der Wiel . | |
| 4,301,315 | 11/1981 | Hasket et al. | 585/332 |
| 4,419,220 | 12/1983 | LaPierre . | |
| 4,594,172 | 6/1986 | Sie . | |
| 4,695,364 | 9/1987 | Graziani . | |
| 4,720,600 | 1/1988 | Beech . | |

FOREIGN PATENT DOCUMENTS

| | | | |
|---|---|---|---|
| 515498 | 8/1955 | Canada | 585/732 |
| 1454498 | 11/1976 | United Kingdom . | |
| 1456858 | 12/1976 | United Kingdom . | |

*Primary Examiner*—Asok Pal

*Attorney, Agent, or Firm*—Alexander J. McKillop; Charles J. Speciale; Laurence P. Hobbes

[57] ABSTRACT

High viscosity index, low pour point lubricants are produced by reacting an iso-paraffinic component, preferably with significant mono- and di-methyl chain branching, with an olefinic reactant in the presence of a free radical generator such as an organic peroxide, preferably ditertiary butyl peroxide. The isoparaffinic reactant is preferably obtained by the isomerization of a waxy feed such as slack wax over a zeolite beta isomerization catalyst, preferably Pt/zeolite beta. The olefinic reactant is preferably a distillate fraction produced by the oligomerization of low molecular weight olefins e.g., $C_3$ to $C_5$ olefins, produced by oligomerization over an intermediate pore size zeolite oligomerization catalyst such as ZSM-5.

17 Claims, No Drawings

PROCESS FOR THE PRODUCTION OF HIGH VI LUBE BASE STOCKS

FIELD OF THE INVENTION

This invention relates to a process for the production of high viscosity index (VI) lubricant base stocks using feed stocks which are readily available in petroleum refineries.

BACKGROUND OF THE INVENTION

In recent years, the efficiencies of automotive engines have increased significantly in order to conserve fuel and to comply with statutory and regulatory requirements on automotive fuel consumption. This increased efficiency has, in turn, led to more severe service requirements for the engine lubricants because the higher efficiencies have generally been accompanied by higher engine temperatures as well as higher bearing pressures concommitant upon the use of higher compression ratios. These increasingly severe service requirements have made it necessary for lubricant manufacturers to provide superior lubricants. Furthermore, it is expected that this trend will continue and that in the future even more severe service ratings will be established by engine manufacturers. At present, the API "SF" rating is currently employed for gasoline engines and this in itself represents a significant increase in the service requirements of lubricants; soon, however, it is expected that even more severe service ratings represented by the API "SG" will become current. Thus, there is a continuing need for lubricants with superior performance characteristics.

One of the performance characteristics which is of greatest significance is the viscosity index (VI). This represents the extent to which the viscosity of a lubricant varies with temperature. Lubricants of high VI change relatively little in viscosity as temperature increases, at least as compared to lubricants of lower VI. Since retention of viscosity at higher temperatures is a desirable characteristic, high viscosity index is desirable. Satisfactory viscosity properties may be conferred either by suitable choice of the lube base stock or by the use of VI improvers which are generally high molecular weight polymers. The extent to which VI properties can be varied by the use of these improvers is, however, limited because not only are large amounts of improver expensive but the improvers are subject to degradation in use so that service life of lubricants containing large amounts of improver may be limited. This implies that improvements in the VI of the base stock are desirable.

One approach to the problem of providing lube base stocks of satisfactory properties has been to employ synthetic base stocks. Base stocks of this type have typically been either synthetic esters similar to the ester type lubricants used in aviation gas turbines or, alternatively, synthetic hydrocarbon generally produced by the polymerization of low molecular weight olefins. Mixtures of the two have also been employed. (Examples of such lubricants are described in U.S. Pat. Nos. 3,997,621 (Oligomerization of 1-Olefins Over Boron Trifluoride Catalyst), U.S. Pat. Nos. 4,182,922 and 4,463,201 (Copolymers of Ethylene, Propylene and Other 1-Olefins) and U.S. Pat. Nos. 4,175,046 and 4,175,047 (Combinations of Synthetic Esters with Olefin Oligomers). Synthetic lubricants such as these have, however, been relatively expensive to produce and for this reason are generally sold in smaller quantities than the cheaper mineral oil lubricants.

Improvements have, of course, been made in the processing of mineral oil lubricants in order to improve the properties of the lube base stocks and a significant advance in this respect is described in European Patent Publication No. 225030 (Application No. 86308429.9 corresponding to U.S. Application Ser. No. 793,937, filed Nov. 1, 1985) which discloses a process for producing high VI lube base stocks from waxy refinery streams by a two stage process involving isomerization of waxy paraffins to isoparaffins of high VI, followed by a selective dewaxing step to obtain the desired pour point for the product. Lubricants produced by this process have extremely desirable properties of high VI coupled with low pour point but limitations on the volume production of this type of lubricant may be imposed by the availability of the waxy refinery streams which form the starting material for the process. The availability of these waxy feed stocks may be dependent upon the production of slack wax in refinery solvent dewaxing units and with the progressive replacement of solvent dewaxing by catalytic dewaxing, the availability of these feedstocks may become limited.

An alternative source of lubricants is provided by the Mobil olefins to gasoline/distillate/lubes process (MOGDL) which converts low molecular weight olefins to gasoline, distillate and lubricant fractions by oligomerization over an acidic, shape selective catalyst such as ZSM-5. This process employs as starting material the olefins which are available in large quantities from catalytic cracking units and is therefore capable of supplementing lubricant supplies to a considerable extent. However, the quality of the MOGDL lubricants is not as high as may be desired for severe service applications and accordingly it would be desirable to develop a way of improving the quality of these semi-synthetic lubricants.

SUMMARY OF THE INVENTION

We have now devised a method for producing very high VI lube products from conventional petroleum refinery streams. These lube products may possess properties comparable to those of the synthetic lube base stocks produced by the oligomerization of olefins such as 1-decene.

According to the present invention, a high VI lube product is produced by reacting a branched chain paraffinic hydrocarbon, in particular, mono and dimethyl branched isoparaffins, with an unsaturated feed stock such as 1-decene to produce a lubricant product of low pour point and high VI. The reaction is preferably carried out in the presence of a peroxide catalyst such as ditertiary butyl peroxide (DTBP) or an acid catalyst such as a zeolite having acidic functionality which promotes the reaction of the unsaturated material with the isoparaffinic feed.

The isoparaffinic feed is preferably obtained by the isomerization of paraffinic feed stocks such as slack wax and for this purpose, zeolite beta provides a preferred isomerization catalyst not only because of its unique paraffin selectivity but also because it produces paraffin isomers which result in the desired products of high VI and low pour point. The unsaturated material is preferably obtained by the oligomerization of low molecular weight olefins by the MOGDL process. Although an objective of the process is to make lubricant products, either or both of the feeds may be distillate materials boiling below the lube boiling range e.g., below 650° F. (345° C.); the process therefore offers a convenient route for upgrading middle distillates into lubricant products of high value.

DETAILED DESCRIPTION

Isoparaffin Component

In the present lube product process, a branched chain, isoparaffinic material is reacted with a olefinically unsaturated hydrocarbon to produce the desired lube product. The branched chain isoparaffinic starting material is preferably a $C_{10}$+isoparaffin and preferably is a middle distillate fraction i.e., a distillate fraction boiling above about 330° F. (about 165° C.), generally with an end point up to about 700° F. (about 370° C.). However, the use of isoparaffin fractions with higher end points is not to be excluded although the amount of the olefinically unsaturated reactant required will be correspondingly reduced in order to maintain the appropriate molecular weight range in the lube product. The boiling range materials (e.g. 650° F.+, 345° C.) may be converted to heavier quality lubricant products by means of the present process. Lube range feeds preferably should have an end point below 1050° F. (about 620° C.). The use of the middle distillate fraction (330° F.+, 165° C.) is desirable because when these fractions are reacted in the amounts described below with the olefinically unsaturated material, the product has an appropriate molecular weight and viscosity for most neutral quality lubricants.

The preferred process for the production of the isoparaffinic reactant comprises the hydroisomerization of a feed stock fraction of suitable boiling point by contact with a zeolite beta hydroisomerization catalyst at elevated temperature. A process of this kind is disclosed in U.S. Pat. No. 4,419,220 to which reference is made for details of the process. Because the properties of the lubricant are improved by the use essentially paraffinic reactants, it is preferred that the hydroisomerization feed should itself be principally paraffinic in character. Thus, it is preferred that the hydroisomerization feed should comprise at least 40 and preferably at least 50 percent paraffins or even more e.g., at least 60 percent paraffins. However, the presence of naphthenes is not unduly disadvantageous although the content of aromatics should be kept relatively low, preferably below 30 and, for best results, below 20 weight percent, since excessive amounts of aromatics tend to lead to deteriorations in product lube quality, especially oxidative and thermal stability. Preferred feed stocks for the hydroisomerization reaction comprise paraffin waxes, including slack wax and de-oiled wax. Other feeds may also be used e.g. 650° F.+(345° C.) gas oils, preferably from paraffinic crude sources. Processes for hydroisomerizing feeds of this type using a zeolite beta isomerization catalyst disclosed in European Patent Application Publication No. 225030 (Application No. 86308429.9), corresponding to U.S. Ser. No. 793,937, filed Nov. 1, 1985 and U.S. Ser. No. 044,187, filed Apr. 30, 1987, to which reference is made for a disclosure of such processes.

The hydroisomerization processes described above employ a zeolite beta based hydroisomerization catalyst and generally, the catalyst will also comprise a hydrogenation/dehydrogenation component, usually a metal or metals of Group VIIIA of the Periodic Table (IUPAC Table). The preferred metal is platinum although palladium and non-noble metals such a nickel may also be employed. Generally, the process will be operated at a temperature of at least about 400° F. (about 205° C.) and generally in the range of 500° to 850° F. (about 260° to 455° C.). If the hydroisomerization feed contains significant quantities of aromatics, relatively higher temperatures may be used so that a measure of hydrocracking takes place concommitantly with the paraffin isomerization and zeolite beta is unique in this respect that it is able to promote the isomerization of paraffinic components of the feed in the presence of aromatics which may themselves be reduced to naphthenes or subjected to hydrogenation and ring opening reactions to form paraffinic components, especially at higher temperatures characteristic of a isomerization/hydrocracking type process.

Other process conditions will be as described in EP 225030 and USSN 793,937 and 044,187, i.e. hydrogen pressures typically from 400 to 3600 psig $H_2$ (2860 to 25,000 kPa), usually about 565 to 1435 psig (about 4000 to 10,000 kPa abs), space velocity, typically 0.2 to 5 LHSV (and hydrogen:feed ratio of 50:1 to 1000:1 (v/v), preferably 200:1–400:1 (v/v).

The products of zeolite beta isomerization reactions are notable for their enhanced content of isoparaffins which renders them particularly attractive for use in the present reaction because the resulting lubricant products contain relatively high numbers of methyl branches which lead to high VI values but relatively low pour points (ASIM D-97).

After undergoing hydroisomerization with the zeolite beta catalyst, the iso-paraffinic component may be subjected to a dewaxing to remove the relatively linear waxy paraffinic components, although this will usually not be necessary with isoparaffinic feeds boiling up to about 700° F. (about 370° C.). If used with higher boiling isoparaffinic feeds, the dewaxing may, as described in EP 225030 and USSN 793,937 and 044,187 referred to above, be either solvent or catalytic or a combination of both with the solvent dewaxing preceding the catalytic dewaxing. A highly selective catalytic dewaxing using a dewaxing catalyst such as ZSM-23 is preferred. Further details of the dewaxing are found in EP 225030 and USSN 793,937 and 044,187 to which reference is made for such details. The isoparaffinic reactant may be subjected to hydrotreating after the hydroisomerization or dewaxing steps, although this is not required.

Olefin Component

The isoparaffinic reactant is modified by reaction in the presence of peroxide with an unsaturated reactant which again, is preferably in the middle distillate boiling range in order to achieve an appropriate molecular weight for the product and the appropriate balance of product properties. Unsaturated reactants of this type typically have at least ten carbon atoms and generally will have from 10 to about 30 carbon atoms so that the final lubricant product has the appropriate properties. Unsaturation will normally be ethylenic in character i.e. comprising carbon-to-carbon double bonds, and in most cases, the product will be predominantly monoolefinic although the presence of diolefins is not to be excluded. The preferred unsaturated reactants of this type can therefore be categorized as middle distillate products and they are suitably produced by the MOGDL process referred to above. In the MOGDL process, a relatively low molecular weight olefinic feed stream such as the olefins from an FCCU e.g., ethylene, propylene, and $C_5$–$C_6$ olefins, are oligomerized in the presence of an acidic, shape selective zeolite to produce unsaturated products of relatively higher molecular weight, including fractions within the desired distillate boiling range for use in the present process. In the distillate production made, the process is operated under elevated pressures and relatively low temperatures to produce the desired iso-olefin product; under relatively higher reaction temperatures, the predominant product is gasoline and process conditions may be varied to favor the formation of hydrocarbons of varying molecular weight.

The conversion of olefins to gasoline and distillate products by this process is disclosed in U.S. Pat. Nos. 3,960,978 and 4,021,502, using gaseous $C_2$–$C_5$ olefins either alone or in admixture with paraffins and an intermediate pore size zeolite such as ZSM-5 for the oligomerization. A process for converting $C^+_3$ olefins to mainly aliphatic hydrocarbons in a similar manner is disclosed in U.S. Pat. No. 4,227,992 and in a related manner, U.S. Pat. Nos. 4,150,062 and 4,201,640 disclose a process for converting olefins to gasoline components. A continuous process for upgrading $C_3$–$C_6$ monolefins with varying amounts of non-reactive paraffins and the like to middle distillates which may be used in the present process is disclosed in U.S. Pat. No. 4,720,600. Reference is made to these disclosures for a detailed description of the MOGD/L process and for preferred conditions for producing the olefinically unsaturated reactants which are used in the present lubricant production procedure.

As disclosed in U.S. Pat. No. 4,720,600, the desired oligomerization-polymerization products obtained from the use of a propylene feed with an appropriate intermediate pore size zeolite catalyst, are $C_{10}^+$ substantially linear aliphatic hydrocarbons. As a result of having both oligomerization/polymerization and cracking reactions occurring in the process (see Garwood, *Intrazeolite Chemistry* 23, American Chemical Society, 1983), a continuous molecular weight distribution will occur in the product which can be independent of the carbon number of the starting material. For example, Garwood has previously shown, at constant temperature and pressure, virtually identical product distribution for feedstocks of ethylene ($C_2$ =), propylene ($C_3$ =), pentene ($C_5$=), hexene ($C_6$=), and decene ($C_{10}$=). Structurally the final product is influenced by the pore structure of the catalyst. For low carbon number products (i.e., $C_4$, $C_5$) isomer distribution is approximately at equilibrium. For the higher carbon numbers, the chain length becomes limited by the dimensions of the largest ZSM-5 pore. At conditions chosen to maximize distillate range products ($C_{10}^+$) the raw aliphatic product is essentially mono-olefinic with 10% or less of the double bond in the alpha position. Overall branching is not extensive, with most branches being methyl at about one branch per four to five carbon atoms.

References is made to U.S. Pat. No. 4,720,600 for a more detailed discussion of process conditions in the MOGD process which are appropriate for producing distillate range hydrocarbons in this manner.

Reaction of Isoparaffinic and Olefinic Components

The olefinically unsaturated component is reacted with the isoparaffinic component in the presence of a catalyst. The catalyst will usually be a free radical initiator, preferably a ditertiary alkyl peroxide or an acidic catalyst, either heterogeneous or homogeneous.

The preferred class of free radical initiators are the peroxides including the ditertiary alkyl peroxide represented by the formula $ROOR^1$ where R & $R^1$ are the same or different tertiary alkyl radicals, preferably lower ($C_4$ to $C_6$) tertiary alkyl radicals. Suitable peroxides of this kind include ditertiary butyl peroxide, ditertiary amyl peroxide and tertiary butyl, tertiary amyl peroxide. Other organic peroxides may also be used including dialkyl peroxides with one to ten carbon atoms such as dimethyl peroxide, diethyl peroxide, dipropyl peroxide, di-n-butyl peroxide, dihexyl peroxide and acetylperoxides such as dibenzoylperoxide.

The amount of peroxy compound used in the process is determined by the molecular weights of the reactants and the molecular weight which is desired in the lube product. In general, the increase in molecular weight is related to the amount of peroxide used with greater increases resulting from greater amounts of peroxide. As a general guide, the amount of peroxide catalyst employed will be from 1 to 50, preferably from 4 to 30 weight percent of the total reactants.

Alternatively, a catalyst having acidic functionality may be used to couple the two hydrocarbon components. Alkylation catalysts will generally be suitable and the catalyst may be either heterogeneous or homogeneous. Lewis acid catalysts such as aluminum trichloride, boron trifluoride, boron trifluoride complexes e.g. with alcohols as well as protonic acids such as hydrogen fluoride and sulfuric acid may be used as homogeneous catalysts. Suitable heterogeneous catalysts include acidic clays and zeolites such as zeolite X, zeolite Y and other large pore size zeolites. These catalysts will be used in amounts and under conditions appropriate for alkylation reactions.

The reaction between the lubricant components is usually carried out at elevated temperature, suitably at temperatures from about 50° C. to about 300° C. and in most cases from 100° C. to about 200° C. with peroxide type catalysts. The treatment duration will normally be from about 1 hour to 6 hours but there is no fixed duration since various starting materials will vary in their reactivity and amenability to coupling by this method. The pressure employed will depend upon the temperature used and upon the reactants and, in most cases, needs to be sufficient only to maintain the reactants in the liquid phase during the course of the reaction. Space velocity in continuous operation will normally be from 0.25 to 5.0 LHSV ($hr^{-1}$).

Peroxide catalysts are converted during the reaction primarily to alcohols whose boiling point will depend upon the identity of the selected peroxide. The alcohol by-product may be removed during the course of the reaction by simple choice of temperature and pressure and accordingly temperature and pressure may be selected together to ensure removal of this by-product. The alcohol may be converted back to the peroxide in an external regeneration step and recycled for further use. If ditertiary butyl peroxide is used, the tertiary butyl alcohol formed may be used directly as a gasoline octane improver or, alternatively, it may be readily converted back to the original di-tertiary butyl peroxide by reaction with butyl hydro-peroxide in the presence of a mineral acid, as described in U.S. Pat. No. 2,862,973, with the butyl hydroperoxide being obtained by the direct oxidation of isobutane, as described in U.S. Pat. No. 2,862,973.

The reaction may be carried out batchwise or continuously and in either case it is preferable to inject the peroxide compound incrementally so as to avoid exotherms and the production of lower quality products associated with high reaction temperatures. If the reaction is carried out in a continuous tubular reactor it is preferred to inject the peroxide compound at a number of points along the reactor to achieve the desired incremental addition although injection of all the peroxide at the reactor inlet is also possible.

The coupled products may include very small amounts of olefins and in order to improve the stability of the final lube products, the peroxide-treated products may be subjected to mild hydrotreating to saturate any lube range olefins. Treatment over a conventional hydrotreating catalyst such as Co/Mo on alumina at mild temperatures typically to 500° F. (260° C.) at relatively low hydrogen pressures, typically up to 1000 psig (7000 kPa) will normally be satisfactory. At low hydrotreating temperatures up to about 550° F., (290° C.) viscosity loss on hydrotreating is minimal although greater losses may be observed at higher temperatures. Pour point and V.I. remain relatively constant with temperature. The use of a hydrotreatment step after the peroxide treatment is capable of removing any residual unsaturation and reducing product bromine numbers to zero or to very low levels e.g. below 1.0. Another option is to carry out solvent extraction with furfural or another solvent after the peroxide treatment in order to remove any residual peroxide compounds or reaction by-products. This post-peroxide solvent extraction may be an additional extraction step or it may be the sole extraction step (for example, the isoparaffinic component may be subjected to extraction prior to the hydroisomerization step to remove aromatic components). Another alternative is to have the furfural extraction follow any dewaxing step since both dewaxing and aramatics extraction may be favored by this sequence. The present processing scheme therefore provides great flexibility of operation in that the required steps may be carried out in various orders. The essential steps are the aramatics extraction, the dewaxing, the hydrotreating and the peroxide treatment all of which have a distinct function and purpose in the entire processing scheme and which may, as described above, be used in various sequences.

Variations in the reactant ratio may be made, typically from about 5:1 to 1:5 molar. Normally, ratios of 3:1 to 1:3 molar are preferred. With middle distillate boiling range isoparaffinic components e.g. about 330°-750° F. (about 165°-400° C.) and middle distillate olefins of comparable boiling range, for example, a 330°-440° F. (105°-227° C.) kerosene or a 440°-650° F. (227°-345° C.) distillate produced by the MOGD process, equimolecular reactant ratios will produce a lube boiling range product (650° F.+, 345° C.+) of neutral quality. Normally, however, it will be preferred to use an excess of the iso-paraffinic component in order to minimise the formation of dimers and higher order oligomers derived from the olefinic component. For this reason, the molar ratio of the isoparaffinic component to the olefinic component is preferably at least 1 e.g. 3:1 to 5:1 (isoparaffinic:olefinic). The molar ratio will not usually exceed 10:1 (isoparaffinic:olefinic). Any excess of the isoparaffinic component may be removed by distillation after the coupling reaction is complete.

It is believed that the reaction proceeds as follows taking a $C_{16}$ waxy hydrocarbon feed as an example. First, the predominantly straight chain n-$C_{16}$ is isomerized over the zeolite beta catalyst to produce branched paraffins, in particular, mono- and di-methyl branched paraffins

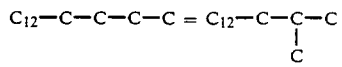

The resulting i-$C_{16}$ product is then reacted with an olefin such as 1-decene to produce a lube range product:

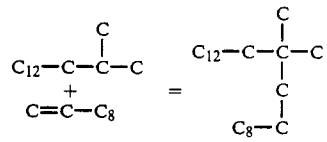

The $C_{26}$ product has the characteristics of a normal paraffin (very high VI) because of its predominantly straight chain structure but it also has a low pour point because the gem-dimethyl substitution interrupts formation of wax at lower temperatures. Consideration of the tentative mechanism above indicates that if the olefin reactant is not terminally unsaturated or the isoparaffinic component does not have 2-methyl substitution, the desirable gem-dimethyl structure will not be obtained, but rather, structures with longer chain branches. Although these structures will confer low product pour point, the VI will suffer since the highest VI values are associated with straight chain configuration. Thus, it is preferred for the iso-paraffin component to be a 2-methyl compound and the olefinic component to be a 1-olefin.

Consideration of the tentative reaction mechanism above shows that the ratio of the isoparaffinic reactant to the olefinic reactant should desirably vary accordingly to the degree of chain branching in the first. For example, if there are beta-methyl groups at both ends of the isoparaffinic component, reaction with two molecules of the olefinic component may yield a lubricant boiling range product with two gem-dimethyl groups which will have good VI and fluidity properties. Thus, the reactant ratio may be selected according to the known characteristics of the feed components.

EXAMPLE

The attached data illustrate the production of lube base stocks by the alkylation of olefins and branched paraffins in the presence of a peroxide coupling agent. The olefin source used was a MOGD distillate (330° F. -650° F., 165°-345° C.) having the following properties.

TABLE 1

| MOGD Distillate Properties | |
|---|---|
| Specific gravity | 0.815 |
| Hydrogen, wt. pct. | 14.07 |
| Molecular weight | 240 |
| Pour point, °F. (°C.) | −65 (−54) |
| KV @ 40° C., cSt | 3.494 |

The isoparaffin feed was a 330° F. -650° F. (165°-345° C.) distillate obtained from hydroisomerization/hydrocracking of slack wax feedstock using Pt/zeolite beta catalyst at 750° F. (about 400° C.), 400 psig, 1 LHSV. This isoparaffinic distillate has the following properties:

TABLE 2

| Isoparaffin Feed Properties | |
|---|---|
| Hydrogen, wt. pct. | 14.76 |
| Aniline point, °F. (°C.) | 175.5 (79.7) |
| Bromine number | 0 |
| Pour point, °F. (°C.) | −40 (−40) |
| Freeze point, °F. (°C.) | −23 (−30) |
| Smoke point, min. | 33 |

The alkylation reaction was carried out in a 1 liter autoclave. The feed mixture consisted of 60/20/20 weight percent ratio of isoparaffinic distillate/MOGD distillate/DIBP. The feed was heated to 250° F. for three hours while being stirred at 100 RPM. The product was then purged with nitrogen to remove by-products such as acetone and alcohol and was distilled at 650° F. to yield 17.9 weight percent 650° F.+(345° C.+) lube fraction having the following properties:

TABLE 3

| Lube Properties | |
|---|---|
| Molecular weight | 315 |
| Pour point, °F. (°C.) | −15 (−26) |
| KV @ 40° C., cSt | 9.719 |
| KV @ 100° C., cSt | 2.586 |
| SUS @ 100° F. (38° C.) | 60 |
| VI | 94 |

We claim:

1. A process for producing a high VI, low pour point lubricant product which comprises reacting an isoparaffinic hydrocarbon having a boiling range from about 330° F. to about 700° F. produced by the isomerization of a waxy paraffinic hydrocarbon feedstock over a zeolite beta isomerization catalyst with an olefinically unsaturated hydrocarbon reactant comprising a distillate fraction having a boiling range from about 330° F. to 650° F. produced by the oligomerization of lower molecular weight olefins over an intermediate pore size zeolite oligomerization catalyst at a molar ratio of from 1:5 to 5:1 to form a 650° F.+ lubricant product, said reacting occurring in the presence of a free radical initiator comprising an organic peroxide compound.

2. A process according to claim 1 in which the reaction is carried out in the presence of a free radical initiator.

3. A process according to claim 2 in which the free radical initiator comprises an organic peroxide compound.

4. A process according to claim 3 in which the organic peroxide compound comprises di-tertiary-butyl peroxide.

5. The process according to claim 1 in which the isoparaffinic reactant comprises a hydrocarbon fraction boiling in the range from about 330° F. to 1050° F.

6. A process according to claim 1 in which the isoparaffinic reactant has a pour point less than 0° F.

7. A process according to claim 1 in which the isoparaffinic reactant is produced by the isomerization of slack wax in the presence of a zeolite beta isomerization catalyst.

8. A process according to claim 7 in which the isomerization catalyst comprises Pt/zeolite beta.

9. A process according to claim 1 in which the isoparaffinic reactant has a pour point less than −20° F.

10. A process according to claim 1 in which the isoparaffinic component is a fraction boiling in the range of 330°–700° F., produced by the isomerization of a slack wax feedstock over a zeolite beta isomerization catalyst.

11. A process according to claim 10 in which the isoparaffinic component has a pour point below −20° F.

12. A process according to claim 1 in which the olefinically unsaturated reactant comprises a terminally unsaturated $C_{10}$ to $C_{30}$ hydrocarbon fraction.

13. A process according to claim 10 in the ratio of the isoparaffinic reactant to the olefinically unsaturated reactant is from 3:1 to 1:3 molar.

14. A process for producing a high viscosity index, low pour point lubricant product which comprises forming a reaction mixture of (i) an iso-paraffinic distillate boiling range hydrocarbon fraction having a boiling range from about 330° F. to about 700° F. produced by the isomerization of a waxy paraffinic hydrocarbon feedstock over a zeolite beta isomerization catalyst, (ii) a distillate boiling range olefinic hydrocarbon oligomer having a boiling range from about 330° F. to 700° F. produced by the oligomerization of $C_2$–$C_5$ olefins in the presence of an intermediate pore size oligomerization catalyst and (iii) a peroxide free-radical initiator, and reacting the mixture to form higher molecular weight, 650° F. + reaction products.

15. A process according to claim 14 in which the molar ratio of the iso-paraffinic fraction to the olefinic oligomer is from 10:1 to 1:1.

16. A process according to claim 14 in which the molar ratio of the iso-paraffinic fraction to the olefinic oligomer is from 5:1 to 1:1.

17. A process according to claim 1 in which the isoparaffinic fraction is produced by the isomerization of a waxy hydrocarbon feed in the presence of a zeolite beta isomerization catalyst.

* * * * *